United States Patent [19]

Davis

[11] Patent Number: 4,708,342

[45] Date of Patent: Nov. 24, 1987

[54] BALANCING GAME DEVICE AND METHOD

[76] Inventor: Michael S. Davis, 6256 Rogers Park Pl., Cincinnati, Ohio 45213

[21] Appl. No.: 818,200

[22] Filed: Jan. 13, 1986

[51] Int. Cl.[4] ..... A63F 9/00

[52] U.S. Cl. ..... 273/1 GF

[58] Field of Search ..... 273/1 GF, 1 GG; 446/1, 446/106, 108, 115, 118, 126, 396, 325

[56] References Cited

U.S. PATENT DOCUMENTS

| | | | |
|---|---|---|---|
| 2,039,121 | 4/1936 | Semple | 273/1 |
| 2,602,263 | 7/1952 | Swirkal | 446/1 |
| 3,092,384 | 6/1963 | Herne | 273/1 GF |
| 3,402,929 | 9/1968 | Glass et al. | 273/1 |
| 3,608,903 | 9/1971 | Cooper | 446/1 |
| 3,614,106 | 10/1971 | Morrison | 273/156 |
| 3,690,656 | 9/1972 | Hughes et al. | 273/1 GF |
| 4,057,247 | 11/1977 | Morrison | 273/1 R |
| 4,071,244 | 4/1977 | Richards | 273/275 |

*Primary Examiner*—Paul E. Shapiro

*Attorney, Agent, or Firm*—George P. Brandenburg

[57] ABSTRACT

A puzzle-type amusement device comprises a novel structural combination of a rigid support member, a plurality of rigid, headed, elongated balance members, and a planar storage member which carries a base protruding therefrom. A method for using such elements includes disposing a first end of the support member in the base, interweaving balance members and balancing the interwoven structures on the support member.

4 Claims, 5 Drawing Figures

BALANCING GAME DEVICE AND METHOD

BACKGROUND OF THE INVENTION

1. Field of the Invention

This invention relates generally to a game and toy and more particularly to a game and toy directed to the balancing of various members on a substantially rigid support member for the use by children and adults through the use of which skill may be acquired and displayed.

2. Description of the Prior Art

Various games or toys are known in the art which require careful manipulation by players of interrelated parts. Various types of building toys, such as building blocks, have been designed and used to construct various shapes or structures of different sizes and designs. Many such games and toys are primarily designed for younger players such as preschool or early school-age children. The games do not require a great deal of thinking or skill to manipulate the interrelated parts, but are designed, primarily, to develop hand-eye coordination or dexterity skills.

Various games of skill have been designed, utilizing a balancing set of interrelaed parts. Such games are those as described by Morrison, et al., in U.S. Pat. No. 3,614,106, entitled "Balancing Puzzle Device" issued Oct. 19, 1971, and another described by Morrison, et al., in U.S. Pat. No. 4,057,247, entitled "Balancing Toy Set" issued Nov. 8, 1977. Such puzzle-type games are known in the art.

The present inventio provides such a construction-type toy and game which is challenging to the player and which will amuse and entertain the player of any particular age, primarily beyond the preschool and beginning school age.

SUMMARY OF THE INVENTION

A primary object of the invention is to provide a toy and game requiring intuition, physical skill and coordination for its use.

A second object of the invention is to provide sufficient members to challenge the player in determining the solution to the balancing game.

Another object of the invention is to provide a toy and game in which the balancing members may be balanced on a support member of like-shape for the completion of the game.

Yet another object of the invention is to provide a game which will challenge the intuition of young and old alike.

A further object of the game is to provide a means of developing a interwoven member of structure made up of individual members which will have a single-point contact within the balancing mass which will balance upon a single support member.

Still, a further object of the game, is to provide a challenging game of skill for more than one player wherein the game requires the skill and intuition previously discussed as well as interaction between the players and the game members.

Other objects, features, and advantages of the invention will be apparent with the follow detailed description, taken in conjunction with the accompanying drawings showing preferred embodiments of the invention.

The present invention, in one form, provides a balancing toy and game of skill which comprises a base member and alternately a minimum of seven building elements or alternate devices wherein one building member is inserted in the base member for use as a pivotal support section and the remaining building elements are arranged in an interlocking weave pattern for subsequent balancing upon the pivotal support member. The invention, as developed, produces a game of skill and a puzzle-type amusement device which requires individual intuition as well as careful manipulation of the balancing members comprising the apparatus for the game and the maintaining of such a balanced condition upon the support member prior to completion of the game.

Thus, by challenging the intuition and manipulative skills of the player, one attempts to support the building elements upon the support member.

DESCRIPTION OF THE PREFERRED EMBODIMENT

Figure 1:
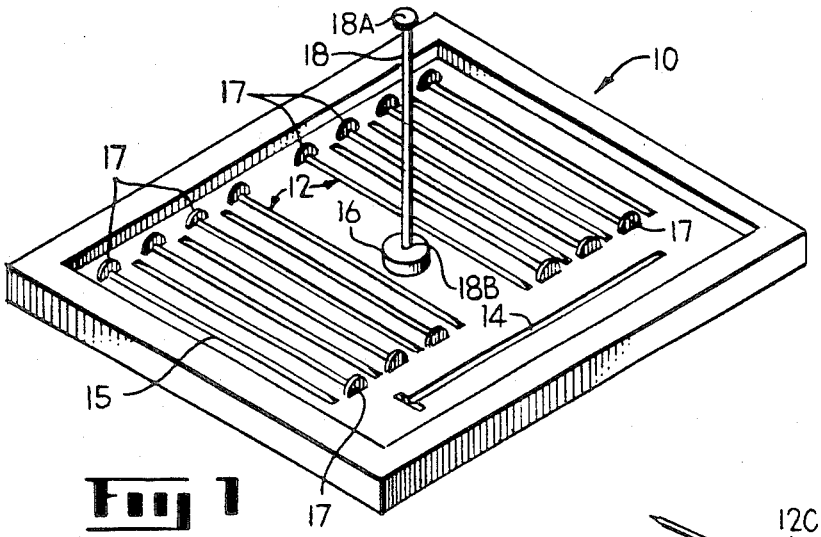
FIG. 1 is a perspective view of the members of the game device of this inventin showing the individual members, the base member, and a means for storing same.

Referring more particularly to the drawings, wherein like numbers refer to like parts in each view, FIG. 1 illustrates the plurality of individual members used in playing the game, solving the puzzle and using the device of the current invention. The individual members 12 are disposed in a storage means for the game members, shown generally at 10. Within the storage means 10 is found the individual members 12 of the game required to form the balancing structure and the support means for the balancing structure. The individual balance members are shown generally at 12, each disposed in a recessed retention slot for member retention prior to the playing of the game of the current invention. A substantially rigid pivotal support member 18 is provided with a retention slot shown at 14. It can be seen from the embodiment of FIG. 1 that the game members are substantially rigid members preferably having an elongated portion 15 of a uniform circular cross section and, with an enlarged head portion at one end as shown at 17. The balancing game can be played with individual members of any general size and shape wherein all members are ideally of identical length, cross section and having an enlarged head portion at one end, such as large, "checker head" nails. However, it can be appreciated by one skilled in the art that the individual members may be of different length and cross-section. The object of the game of the current invention can be played with various items such as golf clubs, baseball bats, or the like, which can be appreciated by one skilled in the art.

Referring further to FIG. 1, it can be seen that a first end 18B of an individual member 18 is inserted in a base member 16 to form the pivotal support member required for completion of the balancing structure or member of the current invention.

Figure 2:
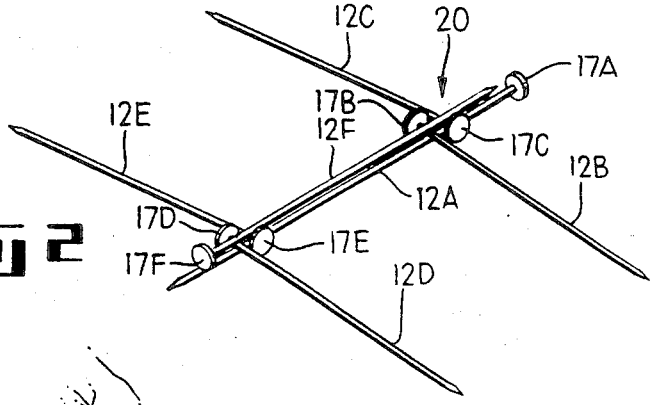
FIG. 2 is a perspective view showing selected individual members in an interwoven arrangement.

One object of the current invention is to balance at least six of the individual balance members 12 upon a second end 18A shown enlarged, of the support member 18. This is performed by utilizing a plurality of members 12 positioned to form an interwoven balancing member shown generally at 20 in FIG. 2. One example of the method whereby the interwoven balancing member is formed is as follows. An individual member 12A in FIG. 2, having an enlarged head portion 17A, is removed from the storage means 10 and placed upon a substantially flat surface. A second game member 12B is removed from storage means 10 and positioned upon the first member in a substantially normal position thereto having the enlarged head portion 17B thereof extending slightly to one side of the elongated or shank portion of the first member 12A. A third member 12C is removed from the storage means 10 and placed substantially normal to the first member with its enlarged head portion 17C extending slightly beyond said first member, said third member being closely adjacent to said second member and lying in a direction directly opposite from said second member, as shown in FIG. 2. A fourth member 12d is removed from the storage means 10 and placed in a substantially normal position to the first member 12A with its enlarged head portion 17D slightly away from the first member 12A. A fifth member 12E is removed from the storage means 10 and placed in a substantially normal position to the first member 12A such that its enlarged head portion 17E is slightly removed from the first member 12A. Said fifth member is closely adjacent to said fourth member and lying in a direction directly opposite from said fourth member as shown in FIG. 2.

A sixth member 12F is removed from the storage means 10 and placed in a position substantially parallel to the first member 12A, the sixth member 12F having its enlarged head portion 17F at the opposite end of the enlarged head portion 17A of the first member 12A and laying substantially upon the second, third, fourth and fifth members.

Figure 3:
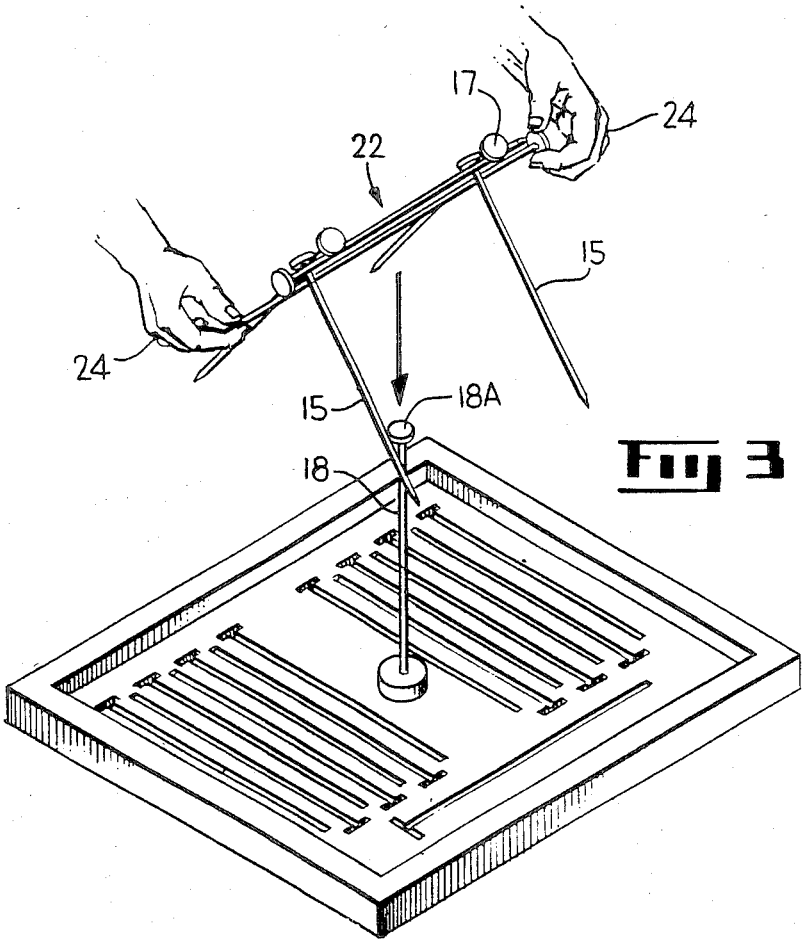
FIG. 3 is a perspective view showing the operation of the invention, wherein the interwoven members are directed toward the support member.

To complete the balancing portion of the current invention, the interwoven balancing member shown generally at 20, Fig. 2, comprising a plurality of members 12, is grasped at the ends of the first member 12A and gently raised such that the second, third, fourth and fifth members will rotate downward when acted upon by gravity and interlock their enlarged head portions with the elongated portion of the sixth member 12F, shown generally at 24, FIG. 3. The interwoven balancing member having the second, third, fourth and fifth members rotated downward as shown generally at 22, in FIG. 3, is then directed toward support member 18 as shown in FIG. 3, and is then placed upon the support member 18, balancing the interwoven balancing member upon the enlarged head portion 18A of the support member 18 wherein the center of gravity of the interwoven member 22 is found before releasing the ends of the first member 12A. Upon the completion of the game, the interwoven balancing member 22 will be balanced upon the support member 18 as shown generally at 26 in FIG. 4.

Figure 4:
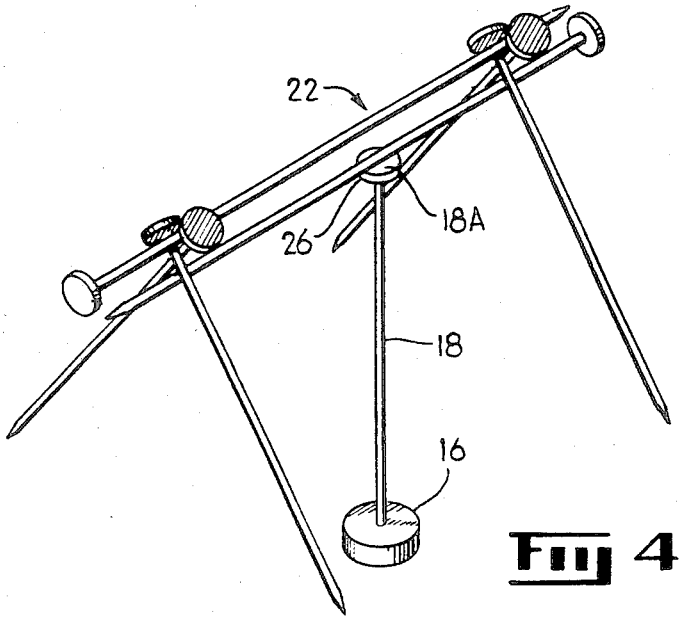
FIG. 4 is a perspective view showing the operation of the invention, wherein the interwoven members are balanced upon the support member.
Figure 5:
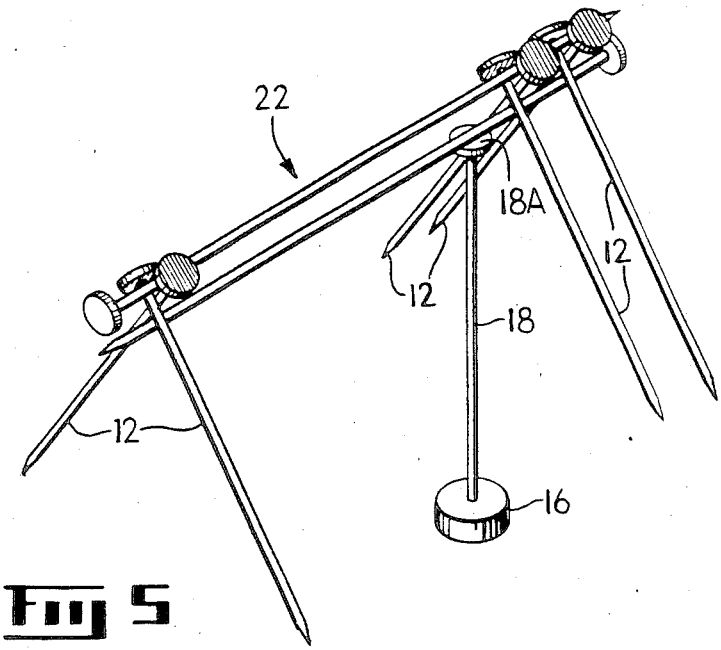
FIG. 5 is a perspective view showing the operation of the invention, wherein additional members are added to the original interwoven members during progress of the game.

It can be appreciated by one skilled in the art, tha the method of plaing the game of the invention described above, will involve one player. The object of the game of the invention for one player is for the player to solve the puzzle by determining the method previously described to form the interwoven member 20 of FIG. 2, and complete same by lifting the interwoven member 20 of FIG. 2, forming the newly adjusted interwoven member 22 of FIG. 3, and successfully placing same upon the support member 18, as shown in FIG. 4. In order to play the game of the invention in a more advanced stage or with other players, the method of playing the game of the invention is modified to use additional individual members 12, as shown in FIG. 5, the play of the game being more fully described below.

To explain the operation of the game of the present invention for two or more players, the game rules and instructions will be presented, with some elaboration, extra explanation and reference to the drawings, etc. that would normally not be contained in such rules and instructions. It will be understood that this is but one set of rules and instructions, that a number of features are optional additions to the basic game above, and that a widely different set of rules and instructions could be equally applicable to the basic game. With the above qualifications in mind, it is believed the basic form of rules and instructions is a good way to set forth and illustrate a specific embodiment of the game apparatus and method of play of the present invention for two or more players.

GAME RULES AND INSTRUCTIONS

©1984 Michael Sebastian Davis

Number of Players

The game may be played with 2, 3 or 4 players.

OBJECT OF THE GAME

The object of the game is to obtain the highest total score, as determined below, by using manipulative and intuitive skills, in the formation of the interwoven balancing member 20, placement of said member on support member 18 and adding or removing additional members 12 to the interwoven balancing member 22 while balanced on support member 18 without causing said interwoven balancing member 22 to fall from support member 18.

EQUIPMENT NEEDED 1 set of dice
24 balance members 12, the color red.
2 balance members 12, the color black.
4 balance members 12, the color yellow.
2 balance members 12, the color yellow, longer in length than the 4 yellow balance members 12, above.
1 support member 18, the color yellow, longer in length than any of the yellow balance members 12, above and having a smaller enlarged head portion.
1 base member 16, with a slot or recepticle for accepting support member 18.

GAME SUMMARY

In each turn the player rolls the dice and adds the sum of each die. If the player rolls an odd number the player must remove two support members 12 from the interwoven member 22, while it balances upon support member 18, (Note: only if there are such members to remove) and then discard them to a pile designated for discarded support members 12. If the player rolls an even number with the dice, the player must add two support members 12 to the interwoven member 22 while it balances upon support member 16. This method of play continues until all red and black support members 12 are either played or discarded.

THE PLAY

To determine order of play, each player rolls the dice and the player with the highest point total of the two die, goes first and the remaining players follow in a clockwise direction.

1. In each turn a player is allowed one roll of the dice; however, if the player rolls double sixes another turn is awarded and if the player rolls "snake eyes" (double 1's) the player loses that turn.

2. The player to begin must take the (6) balance members 12, and the one balance member 18 with the smallest enlarged head portion, and place the first end, away from the head portion, of the support member 18 in the base member 16 in the receptacle provided. The player then takes the (6) balance members 12 and arranges them into interwoven member 20, using the longer length balance members 12 as the first and last members to form interwoven member 20. (Note: The (4) shorter balance members 12, may be placed anywhere between the longer balance members 12, as long as (2) balance members 12 are on one side and (2) balance members 12 are on the opposite side, as shown in FIG. 2.)

3. The player to begin (the one with the highest point total on the initial roll of the dice) takes interwoven member 20 and carefully places said member upon the enlarged portion of the balance member 18 in the center of base member 10, See FIG. 4, forming the interwoven member 22 in the balanced position.

4. If the beginning player successfully completes the structure as shown in FIG. 4 without dumping them, that player has begun the game. If the player upsets the balanced structure as shown in FIG. 4, the next player in rotation (clockwise) must attempt to form the balanced structure and so on until the balanced structure is successfully completed.

SCORING

1. Formation of the balanced structure consisting of all seven yellow balance member 12 scores 25 points.

2. All red balance members 12 and the 2 black balance members 12 are worth 5 points each.

3. The 2 black balance members 12 are bonus members worth an additional 25 points and the bonus points are awarded to the player who is lucky enough to have them turn up during that player's turn. The player is only awarded 25 points for placing the 2 black balance members 12 on the balanced structure, plus 5 points for each balance member 12, making a total of 35 points. If the player in turn rolls an odd number on the dice, that player must remove the black balanced members 12, and that player only receives 10 points and the balance members are put back into rotation in the playing pile.

4. The player with the largest score wins.

RULES

1. The player beginning the game or setting the game up after a dump, must set up the game as shown in FIG. 4 without dumping the individual balance members 12 and they must balance there without touching the table, the base member 10 or the support member 18, other than being allowed to rest on portion 18A of said support member. If the balanced structure dumps the player loses his turn and the next player in rotation has the opportunity to set up and a chance at the 25 set up points. The player dumping the set up only loses his turn and is not penalized points.

2. If at anytime during the game, the balanced structure, once set up, is dumped, the player responsible for the dump must substract 5 points for each red and black balance member 12 dumped, plus the 2 balance members 12 the player is attempting to set up. The yellow balance members 12 only merit you points on the initial set up and are not to be removed at anytime during the game.

3. The next player in rotation then rolls the dice. If he rolls an odd number, he must remove 2 balance members 12 (if any) other than yellow balance member 12 and add 2 balance members 12, if the player rolls an even number. The player will only remove 2 balance members 12, black or red if there are any within the interwoven member 22 of the balanced structure. Example: If there are no red or black balance members 12 in the set up and the player in turn rolls an odd number, the play moves to the next player.

4. If a player rolls double six's he merits another turn and if he rolls double one's, "snake eyes", he loses his turn.

5. All balance members 12 successfully removed (except the 2 black balance members 12) are added to a discard pile, not to be used until another game is played. Black balance members 12 are placed back in rotation in the playing pile and are worth the 25 bonus points each time played.

6. All red or black balance members 12 that are in the set up at the time of a dump, plus the 2 balance members 12 in the players hand are placed in rotation in the playing pile and the player responsible for the dump must subtract 5 points for each red or black balance member 12 so dumped. (Note: If at anytime a player is adding or removing balance members 12 or setting up the balanced structure and the balanced structure leans to one side or another and rests on base 10, the table or support member 18, other than support portion 18A, this constitutes a dump. When a player removes his hands from play the balanced structure must balance on its own upon support member 18). Example: If for the player in turn, the game is already set up with 2 red balance members 12 on the balanced structure, and the player in turn is attempting to put on 2 additional balance members 12, either 1 at a time or simultaneously, and that player causes a dump; that player loses 20 points, 5 for the 2 balance members 12 on the balanced structure, plus the 2 in the player's hands; the red or black balance members 12 are returned to the playing pile and the next person in rotation must complete the balanced structure as shown in FIG. 4.

7. The playing pile at the onset of the game is arranged such that each of the balance members 12 are placed on the playing table in order so that 22 red, 2 black and 2 red balance members 12 are arranged in a single line que. During the play of the game, 2 balance members are removed from the front of the single line que, being generally the left side of the que. Balance members 12 when removed from the balanced structure as a result of a dump are replaced at the end of the que, being generally at the right side of the que.

8. Remember the red balance members 12 successfully removed from the balanced structure are discarded. If the player in turn causes a dump and there are 2 black balance members 12 involved, said black balance members 12 are returned to the end of the playing pile along with the other red balance members 12. Always choose 2 playing balance members 12 from the front of the playing pile line, thus keeping the 2 black balance members 12 moving towards the front of the playing pile line and giving all players a chance for the 25 bonus points. The black balance members 12 are always returned to the playing pile and are never discarded.

9. The player in turn may place 2 balance members 12 anywhere on the balanced structure desired and on any side being careful not to dump the balanced structue, touch the table, base member 10, or the support member 18, other than support portion 18A.

STRATEGY

If the player in turn is losing or not so lucky as the player's opponents, try to beat them by putting balance member 12 in a manner that tilts or almost dumps the balanced structure thus making it hard for the next player to put on additional balance members 12 or remove same without dumping the balanced structure.

COMPLETION OF GAME

The game is over when all red and black balance members 12 in the playing pile are used; the player with the highest score wins.

IN CASE OF A TIE

If a tie score results at the end of the game, the players involved go into a Sudden Victory play-off. No scoring is involved in the play-off. Each player rolls the dice, the highest number sets up. All of the balance members 12 including the ones in the discarded pile, are used. Each player, in turn takes a turn using 2 balance members 12 and adds them to the set up. The play continues in this manner until there is a dump or all of the nails are used. If after playing, all 26 red and black balance members 12 are balanced on support member 18 and there still is no dump, the players then reverse the procedure by removing the red and black balance members 12, 2 at a time until a dump occurs.

It is understood that the invention is not confined to the particular construction, materials, and arrangement of parts herein illustrated and described. Instead, it embraces all such modified forms thereof as should be obvious to those skilled in the art. The invention embraces all modified forms as come within the scope of the following claims.

I claim:

1. A puzzle-type amusement device comprising, in combination:

(a) a rigid pivotal support member;

(b) a plurality of balance members, each having a rigid elongated portion of substantially circular cross section with an enlarged head portion thereon;

(c) a substantially planar storage means including recessed retention slots for said support member and said balance members; and, (d) a base carried by and protruding from said storage means and including a means for accepting a first end of the support member.

2. The device of claim 1 wherein the balance members are large, "checker head" nails.

3. The device of claim 2 wherein the support member is a large, "check head" nail.

4. A method for forming an amusement device comprising the steps of:

providing a rigid support member having a first end and a second end;

providing a base member including a receiving slot for accepting the first end of the support member;

providing a plurality of rigid balance members;

disposing the first end of the support member in the receiving slot;

interweaving a plurality of the balance members about a first of the balance members to form a balancing structure; and, balancing the balancing structure on the second end of the support member remote from the base member.

* * * * *